US010006379B2

(12) United States Patent
Rollinger et al.

(10) Patent No.: US 10,006,379 B2
(45) Date of Patent: Jun. 26, 2018

(54) VARIABLE DISPLACEMENT ENGINE CONTROL

(71) Applicant: Ford Global Technologies, LLC, Dearborn, MI (US)

(72) Inventors: John Eric Rollinger, Troy, MI (US); Adam J. Richards, Canton, MI (US); Robert Michael Grant, Farmington Hills, MI (US); Steven Lin, Ann Arbor, MI (US); Matthew Gerow, Alpena, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days. days.

(21) Appl. No.: 15/250,427

(22) Filed: Aug. 29, 2016

(65) Prior Publication Data

US 2018/0058346 A1 Mar. 1, 2018

(51) Int. Cl.

| | |
|---|---|
| ***F02D 17/02*** | (2006.01) |
| ***F01L 13/00*** | (2006.01) |
| ***F02D 41/26*** | (2006.01) |
| ***F02B 75/02*** | (2006.01) |

(52) U.S. Cl.

CPC ..... *F02D 17/02* (2013.01); *F01L 13/0005* (2013.01); *F02B 75/02* (2013.01); *F02D 41/26* (2013.01); *F01L 2013/001* (2013.01); *F02B 2075/027* (2013.01); *F02D 2200/101* (2013.01); *F02D 2200/50* (2013.01); *F02D 2200/606* (2013.01); *F02D 2200/702* (2013.01); *F02D 2400/02* (2013.01)

(58) Field of Classification Search

CPC ..... F02D 17/02; F02D 41/26; F02D 2200/50; F02D 2200/606; F02D 2400/02; F02D 2200/101; F02D 2200/702; F01L 13/0005; F01L 2013/001; F02B 75/02; F02B 2075/027

See application file for complete search history.

(56) References Cited

U.S. PATENT DOCUMENTS

| | | | | |
|---|---|---|---|---|
| 6,098,994 | A * | 8/2000 | Kunishima ..... | B60G 17/016 280/5.5 |
| 8,347,856 | B2 | 1/2013 | Leone et al. | |
| 8,606,483 | B2 | 12/2013 | Krupadanam et al. | |

(Continued)

OTHER PUBLICATIONS

Anonymous, A method to extend internal combustion engine cylinder deactivation time using rough road detection, Research Disclosure database No. 487059, Nov. 2004 paper journal, ISSN 0374-4353.*

*Primary Examiner* — Joseph Dallo

(74) *Attorney, Agent, or Firm* — Julia Voutyras; McCoy Russell LLP

(57) ABSTRACT

Systems and methods for operating an engine in a variety of different cylinder operating modes are presented. In one example, an actual total number of available cylinder modes is increased in response to a vehicle's suspension setting and road roughness. By increasing the available cylinder modes, the engine may be operated in a higher number of modes where one or more engine cylinders may be deactivated to conserve fuel. The number of cylinder modes is increased during conditions where vehicle occupants may be less likely to object to operating the engine with fewer active cylinders.

20 Claims, 6 Drawing Sheets

(56) References Cited

U.S. PATENT DOCUMENTS

| | | | | |
|---|---|---|---|---|
| 9,702,315 | B1 * | 7/2017 | Palmer | F02D 43/00 |
| 2004/0055569 | A1 * | 3/2004 | Matthews | F01L 13/0005 123/399 |
| 2010/0012072 | A1 * | 1/2010 | Leone | F02D 41/0087 123/192.1 |
| 2013/0197715 | A1 * | 8/2013 | Otanez | B60W 50/082 701/2 |

* cited by examiner

VARIABLE DISPLACEMENT ENGINE CONTROL

FIELD

The present description relates to a system and methods for operating an engine during conditions where one or more cylinders of the engine may be temporarily deactivated to improve engine fuel economy. The methods and system provide for ways of increasing an engine operating region where one or more engine cylinders may be deactivated to improve vehicle fuel economy.

BACKGROUND AND SUMMARY

One or more cylinders of an engine may be temporarily deactivated to improve vehicle fuel economy. The one or more cylinders may be deactivated by ceasing to supply fuel and spark to the deactivated cylinders. Additionally, air flow into and out of the deactivated cylinders may be prevented, or at least significantly reduced, via closing intake and exhaust valves of the deactivated cylinders. Air or exhaust gases may be trapped in the deactivated cylinders to maintain higher pressures in the deactivated cylinders and to recycle energy put into compressing gases in the cylinders.

The engine's crankshaft and firing order are defined to reduce engine noise and vibration when the engine is operating with all its cylinders in an active state. Engine torque production and engine speed may be smoothest (e.g., producing least variation from desired engine torque and desired engine speed) when the engine is operated with its full complement of cylinders. If one or more engine cylinders are deactivated, engine torque variation and engine speed variation from desired values may increase because of longer intervals between combustion events. As such, engine fuel economy may be increased via deactivating cylinders, but noise and vibration from the engine as observed by vehicle occupants may increase. If the engine is operated with higher levels of noise and vibration, vehicle occupants may find riding in the vehicle objectionable. Thus, it may be difficult to provide higher levels of fuel efficiency without degrading the driving experience.

The inventors herein have recognized the above-mentioned limitations and have developed an engine control method, comprising: increasing an actual total number of available cylinder modes from a first actual total number of available cylinder modes to a second actual total number of available cylinder modes via a controller in response to an estimate of roughness of a road exceeding a threshold; and operating an engine via the controller in a cylinder deactivation mode after increasing the actual total number of available cylinder modes.

By increasing the actual total number of available cylinder modes in response to an estimate of roughness of a road exceeding a threshold, it may be possible to provide the technical result of operating an engine in a cylinder deactivation mode at a time when vehicle occupants may be less likely to notice the additional engine noise and vibration. For example, if a vehicle travels down a rough road, the actual total number of available cylinder modes may be increased to allow the engine to operate with two or more deactivated cylinders, whereas if the vehicle operated on a smooth road but otherwise similar conditions, cylinder deactivation for the engine may be prohibited based on engine speed and engine torque.

The present description may provide several advantages. In particular, the approach may provide improved vehicle fuel economy. In addition, the approach may reduce the possibility of disturbing occupants of a vehicle while cylinders are deactivated. Further, the approach may enable or deactivate cylinder deactivation modes responsive to sprung and unsprung vehicle mass so that fuel economy may be increased while vehicle occupants may be less susceptible to noise and vibration that may be related to deactivating engine cylinders.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
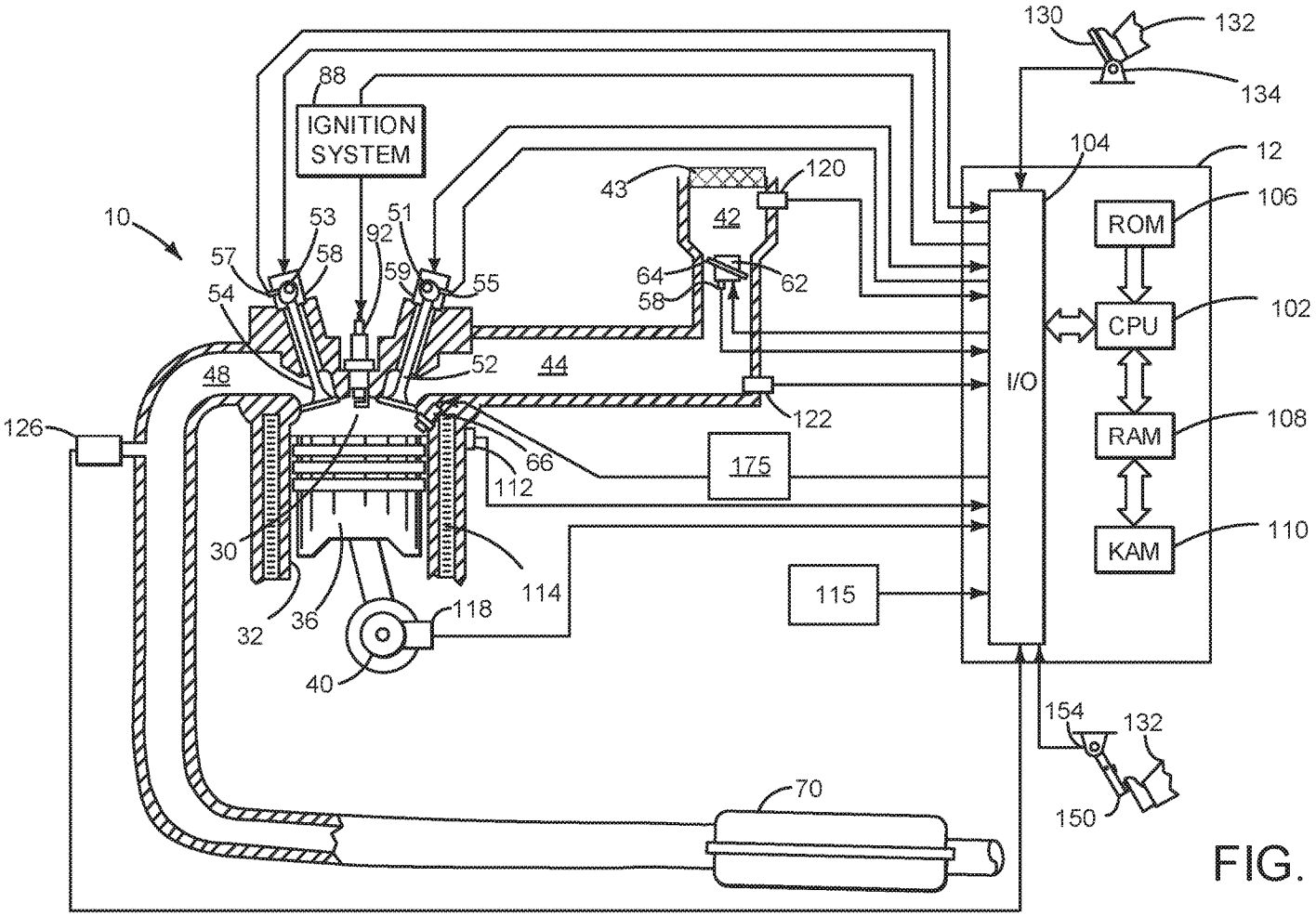
FIG. 1 is a schematic diagram of an engine.
Figure 3B:
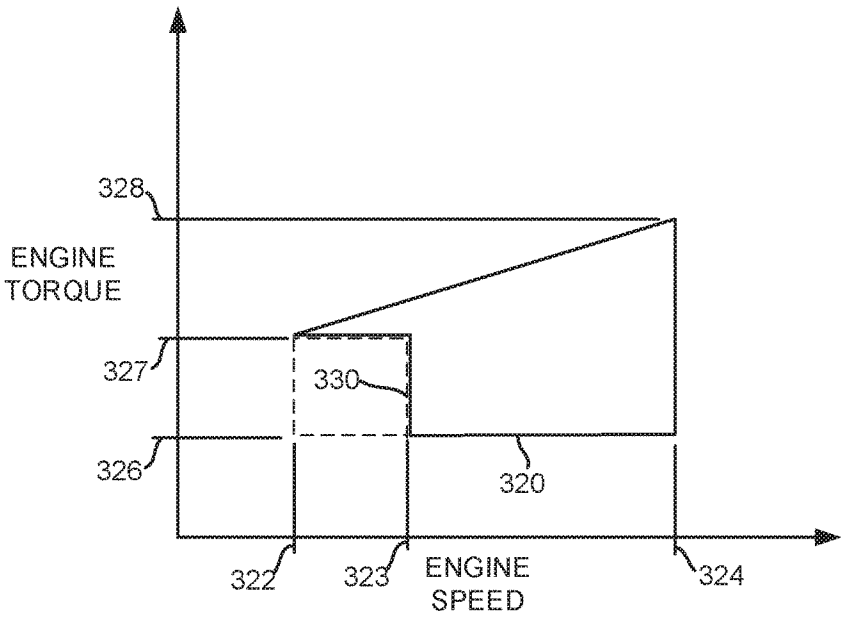
FIGS. 3A and 3B show examples of cylinder deactivation regions.
Figure 3A:
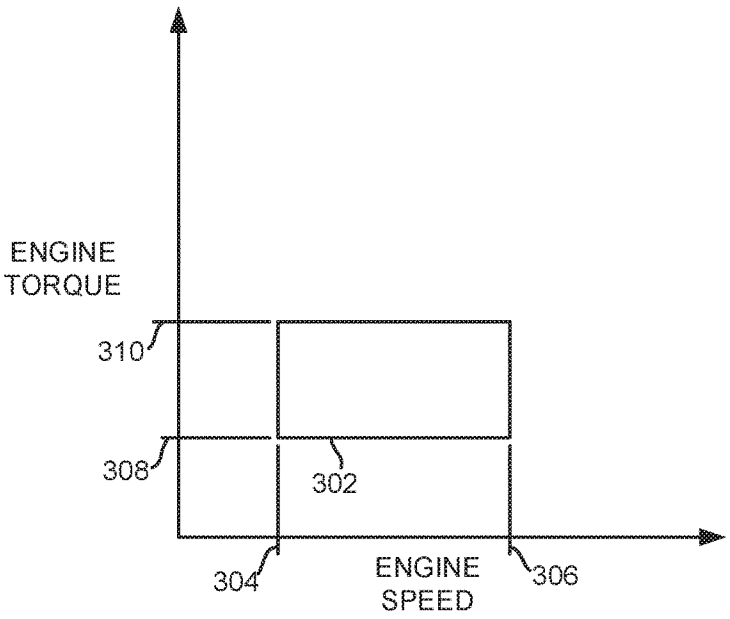
Figure 4A:
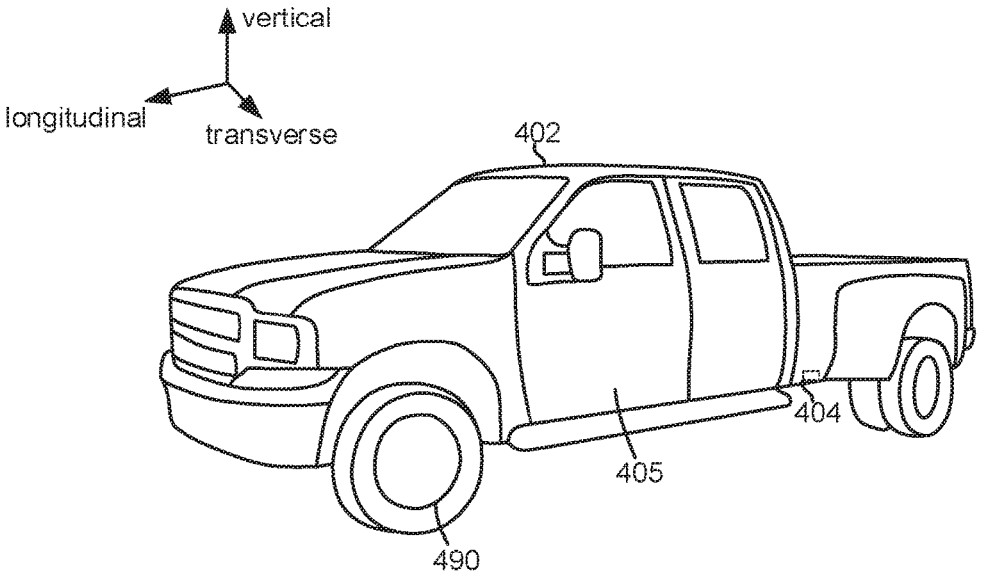
FIGS. 4A-4C show various vehicle suspension components and configurations.
Figure 4B:
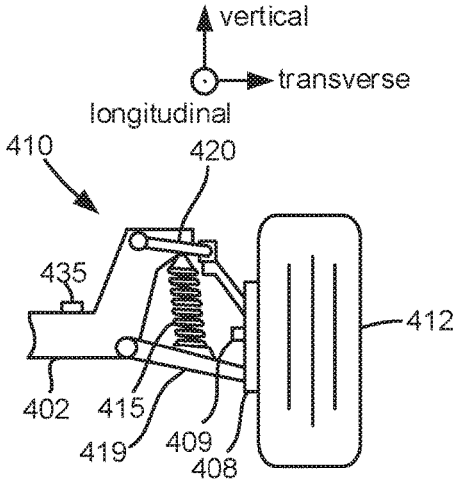
Figure 4C:
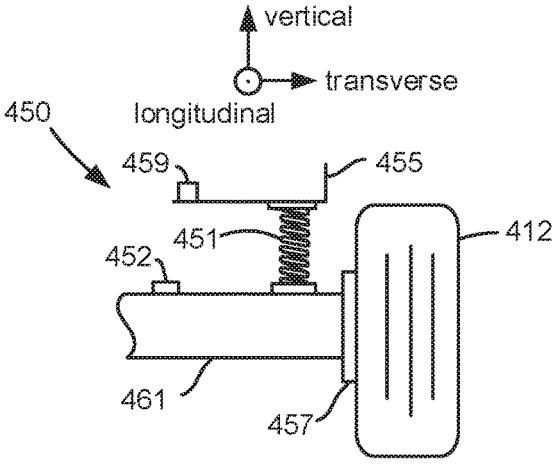
Figure 5:
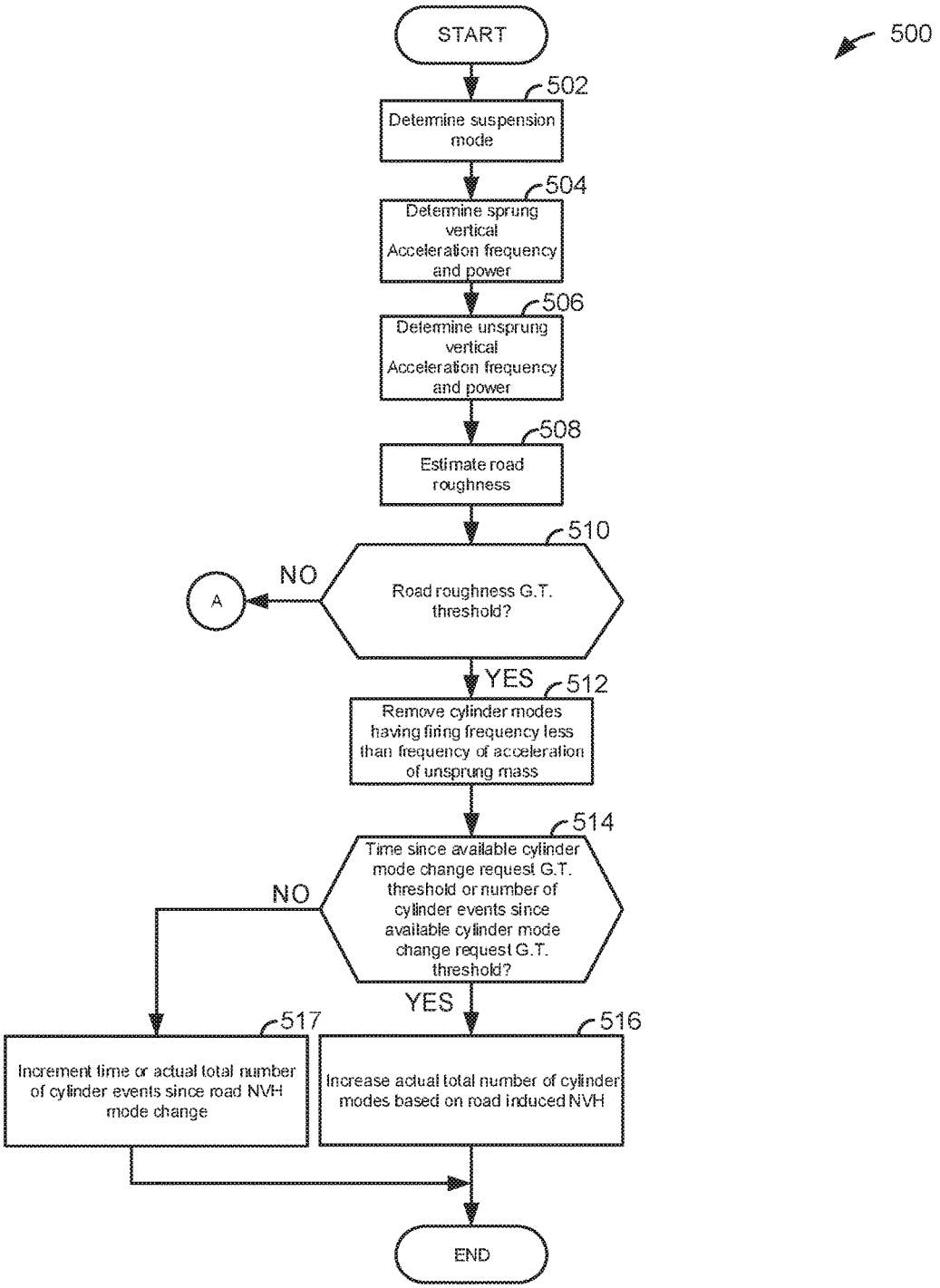
FIGS. 5-6 show a flow chart of an example method for controlling an engine.
Figure 6:
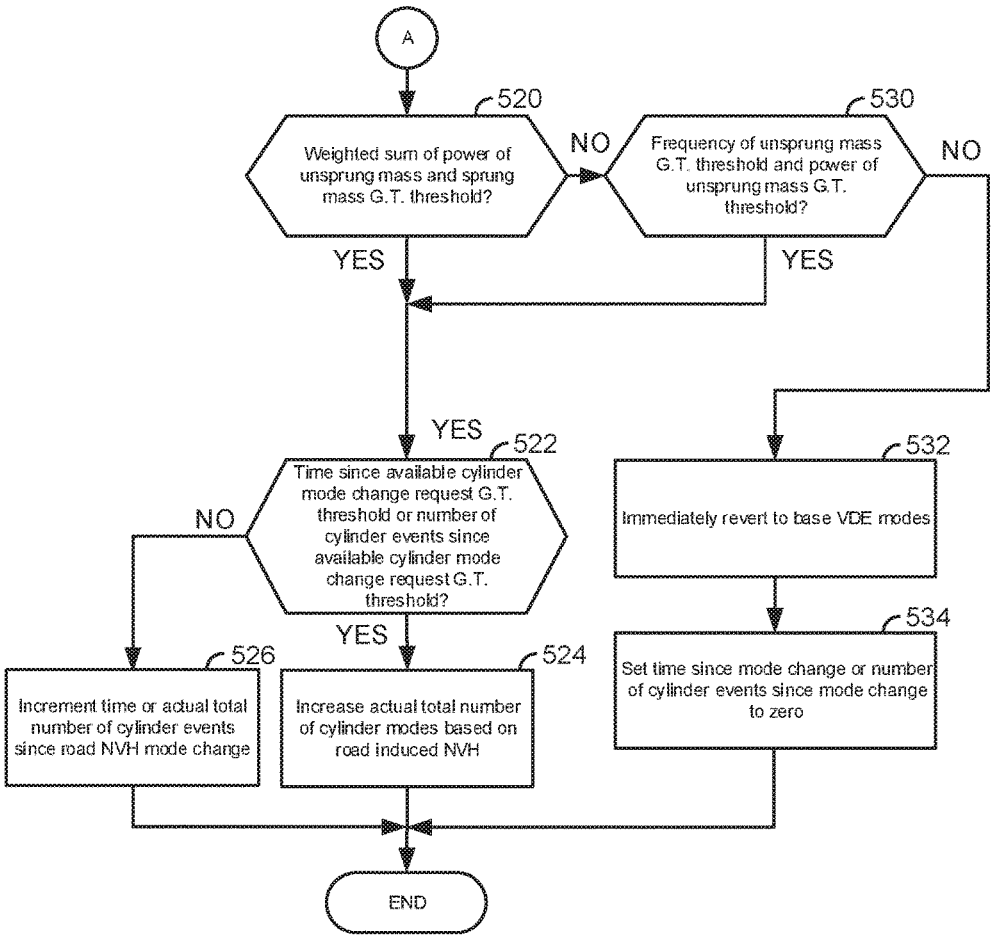

The present description is related to improving engine operation and vehicle drivability during conditions where engine cylinders may be deactivated to improve vehicle fuel efficiency. Cylinders of an engine as shown in FIGS. 1-2B may be selectively deactivated to improve engine fuel efficiency. Engine cylinders may be deactivated in an engine operating range defined by engine speed and load as shown in FIGS. 3A and 3B. The engine cylinders may be deactivated based on acceleration of vehicle components as shown in FIGS. 4A-4C. FIGS. 5 and 6 show an example method for operating an engine that includes cylinders that may be deactivated.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake cam 51 and exhaust cam 53 may be moved relative to crankshaft 40. Intake valves may be deactivated and held in a closed state via intake valve deactivating mechanism 59. Exhaust valves may be deactivated and held in a closed state via exhaust valve deactivating mechanism 58.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system 175, which includes a tank and pump. In addition, intake manifold 44 is shown communicating with optional electronic throttle 62 (e.g., a butterfly valve) which adjusts a position of throttle plate 64 to control air flow from air filter 43 and air intake 42 to intake manifold 44. Throttle 62 regulates air flow from air filter 43 in engine air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human driver 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when human driver 132 applies brake pedal 150; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined. Controller 12 may receive input from human/machine interface 115 (e.g., pushbutton or touch screed display).

In some examples, the engine may be coupled to an electric motor/battery system in a hybrid vehicle. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2A:
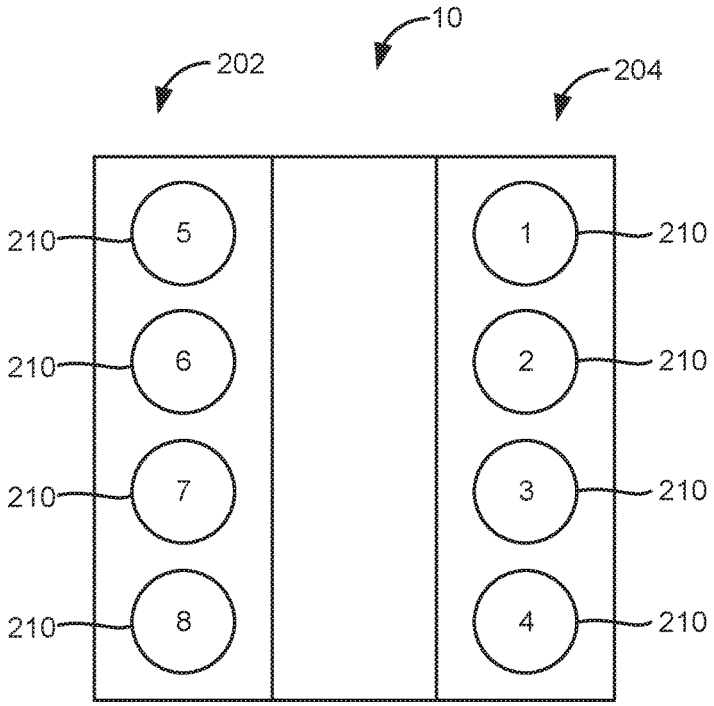
FIGS. 2A and 2B are schematic diagrams of example engine configurations.
Figure 2B:
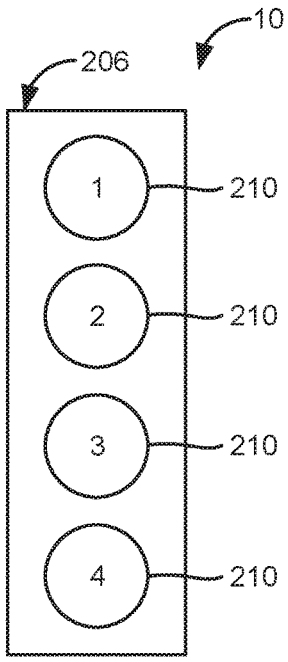

Referring now to FIG. 2A, a first configuration of engine 10 is shown. Engine 10 includes two cylinder banks 202 and 204. First cylinder bank 204 includes cylinders 210 numbered 1-4. Second cylinder bank 202 includes cylinders 210 numbered 5-8. Thus, the first configuration is a V8 engine comprising two cylinder banks. All cylinders operating may be a first cylinder operating mode.

During select conditions, one or more of cylinders 210 may be deactivated via ceasing to flow fuel to the deactivated cylinders. Further, air flow to deactivated cylinders may cease via closing and holding closed intake and exhaust valves of the deactivated cylinders. The engine cylinders may be deactivated in a variety of patterns to provide a desired actual total number of activated or deactivated cylinders. For example, cylinders 2, 3, 5, and 8 may be deactivated forming a first pattern of deactivated cylinders and a second cylinder operating mode. Alternatively, cylinders 1, 4, 6, and 7 may be deactivated forming a second pattern of deactivated cylinders and a third cylinder operating mode. In still another example, cylinders 2 and 8 may be deactivated forming a third pattern of deactivated cylinders and a fourth cylinder operating mode. In yet another example, cylinders 3 and 5 may be deactivated forming a fourth pattern of deactivated cylinders and a fifth cylinder operating mode. In this example, five cylinder operating modes are provided; however, additional or fewer cylinder operating modes may be provided. If engine conditions are such that the engine may operate in any of the five cylinder modes described, the engine may be described as having five available cylinder operating modes. In this example, if two of the engine's five operating modes are not available, the engine may be described as having three available operating modes. The engine always has one available cylinder operating mode (e.g., all cylinders active and combusting air and fuel). Of course, the actual total number of available operating modes may be more than or less than five depending on the engine configuration.

Referring now to FIG. 2B, a second configuration of engine 10 is shown. Engine 10 includes one cylinder bank 206. Cylinder bank 206 includes cylinders 210 numbered 1-4. Thus, the first configuration is an I4 engine comprising one cylinder bank. All cylinders operating may be a first cylinder operating mode for this engine configuration.

Similar to the first configuration, one or more of cylinders 210 may be deactivated via ceasing to flow fuel to the deactivated cylinders. Further, air flow to deactivated cylinders may cease via closing and holding closed intake and exhaust valves of the deactivated cylinders. The engine cylinders may be deactivated in a variety of patterns to provide a desired actual total number of activated or deactivated cylinders. For example, cylinders 2 and 3 may be deactivated forming a first pattern of deactivated cylinders and a second cylinder operating mode. Alternatively, cylinders 1 and 4 may be deactivated forming a second pattern of deactivated cylinders and a third cylinder operating mode. In still another example, cylinder 2 may be deactivated forming a third pattern of deactivated cylinders and a fourth cylinder operating mode. In yet another example, cylinder 3 may be deactivated forming a fourth pattern of deactivated cylinders and a fifth cylinder operating mode. In this example, if engine conditions are such that the engine may operate in any of the five cylinder modes described, the engine may be described as having five available cylinder operating modes. If two of the engine's five operating modes are not available, the engine may be described as having three available operating modes. The engine always has one available cylinder operating mode (e.g., all cylinders active and combusting air and fuel). Of course, the actual total number of available operating modes may be more than or less than five depending on the engine configuration.

In still other examples, different cylinder configurations may be provided. For example, the engine may be a V6 engine or a V10 engine. The different engine configurations may also have different numbers of cylinder operating modes.

Referring now to FIG. 3A, an example cylinder deactivation region 302 for an eight cylinder engine is shown. Cylinder deactivation region 302 is shown as being rectangular, but it may be defined by other polygons or shapes such as a curve that defines a region. Region 302 is defined by a first engine speed 304, a second engine speed 306, a first engine torque 308, and a second engine torque 310. The second engine speed 306 is greater than the first engine speed 304. The second engine torque 310 is greater than the first engine torque 308. Cylinder modes where four and eight cylinders are active may be available within region 302. Eight cylinder mode is the only cylinder mode available outside of region 302. Modes with two active (e.g., cylinders in which air and fuel is combusted) cylinders are not available in region 302. Cylinder modes may not be available due to engine noise and vibration. Thus, the actual total number of available cylinder modes is greater inside of cylinder deactivation region 302 than outside of cylinder deactivation region 302. Such a cylinder deactivation region may be applied when a vehicle is traveling down a smooth road. The relatively small size of region 302 and the cylinder modes that are available within region 302 reduces the possibility of providing objectionable vehicle operating conditions to vehicle occupants. The scale of FIG. 3A is the same as for FIG. 3B.

Referring now to FIG. 3B, an example second cylinder deactivation region 320 for an eight cylinder engine is shown as a solid line. Cylinder deactivation region 302 is shown as being trapezoidal, but it may be defined by other polygons or shapes such as a curve that defines a region. Region 320 is defined by a first engine speed 322, a second engine speed 324, a first engine torque 326, and a second engine torque 326. The second engine speed 324 is greater than the first engine speed 322. The second engine torque 328 is greater than the first engine torque 326.

Cylinder deactivation region 330 is outlined via a dotted line. Region 330 is defined by a first engine speed 322, a second engine speed 323, a first engine torque 326, and a second engine torque 327. The second engine speed 323 is greater than the first engine speed 322. The second engine torque 327 is greater than the first engine torque 326.

Thus, FIG. 3B shows two cylinder deactivation regions. Cylinder modes where four and eight cylinders are active may be available within region 320. Eight cylinder mode is the only cylinder mode available outside of region 320 and outside of region 330. Cylinder modes with two active cylinders, four active cylinders, and eight active cylinders are available in region 330. Cylinder modes may not be available due to engine noise and vibration. Thus, the actual total number of available cylinder modes is greater inside of cylinder deactivation region 330 than inside of region 320 or outside of cylinder deactivation regions 330 and 320. Such cylinder deactivation regions may be applied when a vehicle is traveling down a rough road. The larger region comprising region 320 and 330 increases the possibility of improving vehicle fuel economy. Further, the additional cylinder modes available in region 330 may also further increase fuel economy. As such, when the vehicle is driving down a rougher road where engine noise and vibration that may be due to deactivating engine cylinders may be less noticeable, the engine operating region where cylinder deactivation modes are available increases. Further, the actual total number of available cylinder modes may be increased since road roughness may mask engine noise and vibration from vehicle occupants.

Referring now to FIG. 4A, an example vehicle 402 in which engine 10 may reside is shown. Vehicle 402 includes a three axis accelerometer 404 that may sense sprung chassis vertical acceleration, longitudinal acceleration, and transverse acceleration. Vertical, longitudinal, and transverse directions are indicted via the illustrated coordinates. Sprung chassis components are components that are supported via suspension springs. Thus, body 405 is a sprung mass while wheel 490 is an unsprung mass. FIGS. 4B and 4C show additional examples of sprung and unsprung masses.

FIG. 4B shows an example chassis suspension 410 for vehicle 402 or a similar vehicle. Tire 412 is mounted to a wheel (not shown) and the wheel is mounted to hub 408. Hub 408 is mechanically coupled to lower control arm 419 and upper control arm 420. Upper control arm 420 and lower control arm 419 may pivot about chassis support 402, which may be part of the vehicle's body. Spring 415 is coupled to chassis support 402 and lower control arm 419 such that spring 415 supports chassis support 402. Hub 408, upper control arm 420, and lower control arm 419 are unsprung since they are not supported by spring 415 and they move according to a surface of the road the vehicle is traveling on. A damper (not shown) may accompany spring 415 to provide a second order system. Accelerometer 409 may sense vertical acceleration of unsprung chassis components, whereas accelerometer 435 may sense vertical acceleration of sprung chassis components. Accelerometer 409 may provide a more direct indication of how unsprung chassis components are responding to the road surface. Accelerometer 435 may provide an indication of how sprung chassis components respond to road surface conditions that reach sprung chassis components. Further, accelerometer 435 may provide an indication of engine vibration related to cylinder deactivation that reaches sprung chassis components and that may reach vehicle occupants.

Output of accelerometer 409 may provide an improved basis for determining how much road related noise vehicle occupants may observe due to motion of unsprung chassis components and tire noise as compared to output of accelerometer 435, which senses acceleration of sprung mass. This may be especially true if suspension springs and/or dampeners have been replaced with different components or if they are in degraded condition. Output of accelerometer 435 may sense engine vibration and accelerations that may not be inferred or sensed by accelerometer 409 due to suspension springs and dampeners.

FIG. 4C shows another example chassis suspension 450 for vehicle 402 or a similar vehicle. Tire 412 is mounted to a wheel (not shown) and the wheel is mounted to hub 457. Hub 457 is mechanically coupled to axle 461. Spring 451 is coupled to chassis 455 and axle 461. Hub 408 and axle 461 are unsprung since they are not supported by spring 451 and they move according to a surface of the road the vehicle is traveling on. A damper (not shown) may accompany spring 451 to provide a second order system. Accelerometer 452 may sense vertical acceleration of unsprung chassis components, whereas accelerometer 459 may sense vertical acceleration of sprung chassis components. Accelerometer 452 may provide a more direct indication of how unsprung chassis components are responding to the road surface. Accelerometer 459 may provide an indication of how sprung chassis components respond to road surface conditions that reach sprung chassis components. Further, accelerometer 459 may provide an indication of engine vibration related to cylinder deactivation that reaches sprung chassis components and that may reach vehicle occupants.

Output of accelerometer 452 may provide an improved basis for determining how much road related noise vehicle occupants may observe due to motion of unsprung chassis components and tire noise as compared to output of accelerometer 459, which senses acceleration of sprung mass. This may be especially true if suspension springs and/or dampeners have been replaced with different components or if they are in degraded condition. Output of accelerometer 459 may sense engine vibration and accelerations that may not be inferred or sensed by accelerometer 452 due to suspension springs and dampeners.

Referring now to FIGS. 5 and 6, an example flow chart for a method for operating an engine is shown. The method of FIGS. 5 and 6 may be incorporated into and may cooperate with the system of FIGS. 1 and 2. Further, at least portions of the method of FIGS. 5 and 6 may be incorporated as executable instructions stored in non-transitory memory while other portions of the method may be performed via a controller transforming operating states of devices and actuators in the physical world.

At 502, method 500 determines a mode of the vehicle's suspension. In one example, the vehicle may have two or more modes including track (e.g. stiff or non-compliant suspension), sport (e.g., intermediate stiffness suspension), and touring (e.g., compliant suspension). The suspension mode may be determined via a user input device. Method 500 proceeds to 504.

At 504, method 500 determines vertical acceleration frequency and power of a sprung vehicle mass such as a chassis component or body component. The vertical acceleration frequency may be determined via applying a Fourier transform on an output signal of an accelerometer residing on a sprung vehicle component. The Fourier transform may be expressed as:

$$y_s = \sum_{k=0}^{N-1} \omega^{ks} x_{k+1}$$

where $\omega = e^{-2\pi i/n}$, k and s are indices, and x is the signal sample. The signal power may be determined from output of a vertical accelerometer and the following equation:

$$P = \frac{1}{N} \sum_{n=0}^{N-1} x^2[n]$$

where P is the signal power, N is the number of samples, x[n] is the value of the sample at sample n. Method 500 proceeds to 506.

At 506, method 500 determines vertical acceleration frequency and power of an unsprung vehicle mass such as a chassis component or body component (e.g., a wheel hub or suspension control arm). The vertical acceleration frequency may be determined via applying a Fourier transform on an output signal of an accelerometer residing on an unsprung vehicle component. Signal power and frequency are determined via signal power and Fourier transforms described at 504. Method 500 proceeds to 508.

At 508, method 500 estimates road roughness. In one example, method 500 estimates road roughness based on output of a three axis accelerometer. In particular, averages or integrated values of vertical acceleration, longitudinal acceleration, and transverse acceleration over a predetermined time are summed to provide a single value that provides an indication of road roughness. The vertical, longitudinal, and transverse accelerations may be weighted to increase or decrease influence of the respective axis via weighting factors for each of the respective axis. Further, the estimate of road roughness is modified in response to the suspension mode the vehicle is operating in. In one example, the road roughness may be determined via the following equation:

$$RR = Sm((Pv \cdot W_1) + (Pl \cdot W_2) + (Pt \cdot W_3))$$

where RR is the road roughness, Sm is a multiplier for suspension mode, Pv is the power output from the vertical accelerometer, Pl is the power output from the longitudinal accelerometer, Pt is the power output from the transverse accelerometer, $W_1$ is a weighting factor for the vertical accelerometer, $W_2$ is a weighting factor for the longitudinal accelerometer, and $W_3$ is a weighting factor for the transverse accelerometer. The value of Sm may be different for the different suspension modes such that changing the suspension mode may cause the actual total number of active cylinder modes to increase by increasing the road roughness value. For example, a sport suspension mode may have a higher damping ratio than a touring suspension mode. Therefore, the value of Sm may be adjusted so that the road roughness value increases for operating the vehicle in sport suspension mode. Consequently, changing the vehicle's suspension mode may increase or decrease an actual total number of available cylinder modes depending on the road being driven on by the vehicle. Method 500 proceeds to 510 after estimating road roughness.

At 510, method 500 judges if road roughness is greater than (G.T.) a first threshold. If so, the answer is yes and method 500 proceeds to 512. Otherwise, the answer is no and method 500 proceeds to 520 and FIG. 6.

At 520, method 500 judges if a weighted sum of power of vertical acceleration of the unsprung vehicle suspension mass plus power of vertical acceleration of the sprung vehicle suspension mass is greater than a second threshold. For example, method may judge if $P_{chassis}=W_4 \cdot P_{us}+W_5 \cdot P_s$ is greater than a second threshold, where $P_{chassis}$ is the weighted sum of power of vertical acceleration of the unsprung vehicle suspension component $P_{us}$, $W_4$ is a weighting factor, $P_s$ is power of vertical acceleration of the sprung vehicle suspension component, and $W_5$ is a weighting factor. If method 500 judges that the weighted sum of power of vertical acceleration of the unsprung vehicle suspension mass plus power of vertical acceleration of the sprung vehicle mass is greater than the second threshold, the answer is yes and method 500 proceeds to 522. Otherwise, the answer is no and method 500 proceeds to 530.

The weighted sum of power of vertical acceleration of the unsprung vehicle suspension mass and power of vertical acceleration of the sprung vehicle suspension mass being greater than a threshold may indicate that road induced noise and vibration may be sufficient to mask noise and/or vibration that may emanate from the engine operating with an increased number of deactivated cylinders. As such, the actual total number of available cylinder modes may be increased.

At 530, method 500 judges if dominant frequency of acceleration of an unsprug suspension mass is greater than a third threshold and if an unsprung mass vertical acceleration power of the vehicle's suspension is great than a fourth threshold. The unsprung mass may be an axle, wheel hub, suspension control arm, or other suspension component. The dominant frequency of acceleration may be the frequency at which the unsprung vehicle suspension mass has a greatest power or power greater than a predetermined threshold. The unsprung mass vertical acceleration power may be determined as described at 506. The unsprung mass frequency of acceleration may be determined as described at 506. If the frequency of acceleration of the unsprung suspension mass is greater than the third threshold and if unsprung mass vertical acceleration power of the vehicle's suspension is greater than a fourth threshold, the answer is yes and method 500 proceeds to 522. Otherwise, the answer is no and method 500 proceeds to 532. In some examples, method 500 may also require that engine firing frequency in the available cylinder modes is greater than the unsprung and/or sprung frequency of the vehicles suspension components before increasing the number of available cylinder modes.

The frequency of the unsprung vehicle suspension mass being greater than a threshold and power of vertical acceleration of the unsprung vehicle suspension mass being greater than a threshold may indicate that tire and vehicle suspension noise and vibration may be sufficient to mask noise and/or vibration that may emanate from the engine operating with an increased number of deactivated cylinders. Therefore, the actual total number of available cylinder modes may be increased. The accelerometer sensing unsprung vehicle suspension motion may provide an improved signal for estimating road and tire noise than the sprung vehicle suspension sensor.

At 522, method 500 judges if an amount of time since a last cylinder mode change request to increase an actual total number of available cylinder modes is greater than a third threshold or if a total actual number of cylinder events since a last request to increase an actual total number of available cylinder modes is greater than a fourth threshold. Cylinder events may include initiating combustion in a cylinder during a cylinder cycle via generating a spark in the cylinder (e.g., ignitions), opening or closing intake or exhaust valves, injecting fuel to the cylinder, or other combustion related events for the cylinder cycle. The time or the actual total number of cylinder events may start to accumulate after a latest or last request to increase the actual total number of active cylinder modes. By using an actual total amount of time after a request to increase an actual total number of available cylinder modes as a basis for increasing the actual total number of active cylinder modes, the amount of time to enable additional available cylinder modes may be made consistent.

Alternatively, by using an actual total number of cylinder or combustion events after a latest or most recent request to increase an actual total number of available cylinder modes as a basis for increasing the actual total number of active cylinder modes, the available cylinder modes may be enabled and increased sooner if engine speed is higher or the cylinder modes may be enabled or increased later if engine speed is slower. Consequently, if engine operating conditions change such that a greater number of available cylinder modes are desired, the engine may be provided a consistent number of combustion or cylinder events to stabilize under the new operating conditions so that the actual total number of available cylinder modes are activated consistently on an engine event basis, which may improve engine air-fuel control and reduce engine torque disturbances if one of the newly available cylinder modes are activated. Conversely, if the number of available cylinder modes is changed based on an amount of time since a request to change the number of available cylinder modes, the available cylinder modes may be increased or decreased inconsistently with respect to the number of cylinder or combustion events after a request to increase or decrease the actual total number of available cylinder modes. This may result in entering a new cylinder mode before conditions for operating the engine with fewer active cylinders have stabilized or entering a cylinder mode later so that opportunity to improve fuel consumption may be reduced. These conditions may be avoided via adjusting the actual total number of available cylinder modes responsive to engine combustion or cylinder events since a latest request to adjust the actual total number of available cylinder modes.

If method 500 judges that the amount of time since a last request to adjust the actual total number of available cylinder modes is greater than a threshold or if an actual total number of cylinder or combustion events since a last request to adjust the actual total number of available cylinder modes is greater than a threshold, the answer is yes and method 500 proceeds to 524. Otherwise, the answer is no and method 500 proceeds to 526.

At 526, method 500 increments the amount of time since the request to change the actual total number of available cylinder modes was requested. Alternatively, method 500 increments the actual total number of combustion events or cylinder events since the last request to change the actual total number of combustion events according to the actual total number of cylinder events or combustion events since the last request to change the actual total number of available cylinder modes. Method 500 also requests an increase in the actual total number of available cylinder modes to improve vehicle fuel economy when vehicle occupants may be less aware of cylinder deactivation. Method 500 proceeds to exit.

At 524, method 500 increases the actual total number of available cylinder modes. By increasing the actual total number of available cylinder modes, it may be possible to operate the engine with fewer active cylinders and additional deactivated cylinders. For example, a V8 engine may change from on available cylinder mode (e.g., all active cylinders) to three available cylinder modes: all eight cylinders active; a first group of four cylinders active; and a second group of four cylinders active. The actual total number of available cylinder modes may be increased via increasing a speed range and torque range in which the available cylinder modes are active (e.g., as described in FIGS. 3A and 3B). The engine is operated in one of the available cylinder modes included in the actual total number of available cylinder modes. The engine may be operated in one of the cylinder modes via activating or deactivating engine cylinders. Method 500 proceeds to exit.

At 532, method 500 reverts to base variable displacement engine cylinder operating modes. For example, the base cylinder mode for a V8 engine is all engine cylinders being active combusting air and fuel. A base cylinder mode for a six cylinder engine may be all six cylinders being active. A base cylinder mode for a four cylinder engine may be all four cylinders being active. The base cylinder modes are fewer than the total actual number of cylinder modes. The actual total number of available cylinder modes may be equal to or less than the total actual number of cylinder modes. In one example, the base cylinder modes for an engine are cylinder modes that may be entered during all driving conditions without disturbing vehicle occupants or increasing the possibility of engine degradation. Method 500 proceeds to 562 after reverting to base cylinder modes.

At 534, method 500 sets a time since a latest request to change the actual total number of active cylinder modes to a value of zero. Alternatively, method 500 sets an actual total number of cylinder events or combustion events since a latest request to change the actual total number of active cylinder modes to a value of zero.

Thus, if a single value representing road roughness is not increased to a value greater than a first threshold, the actual total number of available cylinder modes may be increased to improve vehicle fuel economy based a weighted sum of unsprung vehicle mass vertical acceleration power and sprung vehicle mass vertical acceleration power being greater than a threshold. The unsprung vehicle mass acceleration may be indicative of road noise and time noise that may mask noise of deactivated cylinders so that even if vehicle body acceleration is low due to suspension operating mode, the actual total number of available cylinder modes may still be increased to improve vehicle fuel economy when unsprung component noise may mask noise caused by deactivated cylinders. Further, if unsprung mass acceleration power is not available from vehicle sensors, method 500 may proceed directly to 532 from 510.

At 512, method 500 may remove cylinder modes from available cylinder modes that have a firing frequency that is less than a dominant frequency of acceleration of the unsprung vehicle suspension mass. The dominant frequency may be the frequency at which the unsprung vehicle suspension mass has a greatest power. For example, if the unsprung vehicle mass has a dominant frequency of 10 Hz, and operating the engine with one active cylinder during a cylinder cycle at the present engine speed provides 9 Hz, the cylinder mode with one active cylinder is removed from the available cylinder modes. In this way, the actual total number of available cylinder modes may be reduced. Method 500 proceeds to 514.

At 514, method 500 judges if an amount of time since a last cylinder mode change request to increase an actual total number of available cylinder modes is greater than a third threshold or if a total actual number of cylinder events since a last request to increase an actual total number of available cylinder modes is greater than a fourth threshold. Cylinder events may include initiating combustion in a cylinder during a cylinder cycle via generating a spark in the cylinder, opening or closing intake or exhaust valves, injecting fuel to the cylinder, or other combustion related events for the cylinder cycle. The time or the actual total number of cylinder events may start to accumulate after a latest or last request to increase the actual total number of active cylinder modes. By using an actual total amount of time after a request to increase an actual total number of available cylinder modes as a basis for increasing the actual total number of active cylinder modes, the amount of time to enable additional available cylinder modes may be made consistent.

Alternatively, by using an actual total number of cylinder or combustion events after a request to increase an actual total number of available cylinder modes as a basis for increasing the actual total number of active cylinder modes, the available cylinder modes may be enabled and increased sooner if engine speed is higher or the cylinder modes may be enabled or increased later if engine speed is slower. Consequently, if engine operating conditions change such that a greater number of available cylinder modes are desired, the engine may be provided a consistent number of combustion or cylinder events to stabilize under the new operating conditions so that the actual total number of available cylinder modes are activated consistently on an engine event basis, which may improve engine air-fuel control and reduce engine torque disturbances if one of the newly available cylinder modes are activated. Conversely, if the number of available cylinder modes is changed based on an amount of time since a request to change the number of available cylinder modes, the available cylinder modes may be increased or decreased inconsistently with respect to the number of cylinder or combustion events after a request to increase or decrease the actual total number of available cylinder modes. This may result in entering a new cylinder mode before conditions for operating the engine with fewer active cylinders have stabilized or entering a cylinder mode later so that opportunity to improve fuel consumption may be reduced. These conditions may be avoided via adjusting the actual total number of available cylinder modes responsive to engine combustion or cylinder events since a latest request to adjust the actual total number of available cylinder modes.

If method 500 judges that the amount of time since a last request to adjust the actual total number of available cylinder modes is greater than a threshold or if an actual total number of cylinder or combustion events since a last request to adjust the actual total number of available cylinder modes is greater than a threshold, the answer is yes and method 500 proceeds to 516. Otherwise, the answer is no and method 500 proceeds to 517.

At 517, method 500 increments the amount of time since the request to change the actual total number of available cylinder modes was requested. Alternatively, method 500 increments the actual total number of combustion events or cylinder events since the last request to change the actual total number of combustion events according to the actual total number of cylinder events or combustion events since the last request to change the actual total number of available cylinder modes. Method 500 also requests an increase in the actual total number of available cylinder modes to improve vehicle fuel economy when vehicle occupants may be less aware of cylinder deactivation. Method 500 proceeds to exit.

At 516, method 500 increases the actual total number of available cylinder modes. By increasing the actual total number of available cylinder modes, it may be possible to operate the engine with fewer active cylinders and additional deactivated cylinders. For example, a V8 engine may change from on available cylinder mode (e.g., all active cylinders) to three available cylinder modes: all eight cylinders active; a first group of four cylinders active; and a second group of four cylinders active. The actual total number of available cylinder modes may be increased via increasing a speed range and torque range in which the available cylinder modes are active (e.g., as described in FIGS. 3A and 3B). The engine is operated in one of the available cylinder modes included in the actual total number of available cylinder modes. The engine may be operated in one of the cylinder modes via activating or deactivating engine cylinders. Method 500 proceeds to exit.

Thus, the method of FIGS. 5 and 6 provides for an engine control method, comprising: increasing an actual total number of available cylinder modes from a first actual total number of available cylinder modes to a second actual total number of available cylinder modes via a controller in response to an estimate of roughness of a road exceeding a threshold; and operating an engine via the controller in a cylinder deactivation mode after increasing the actual total number of available cylinder modes. The method includes where the available cylinder modes include cylinder modes where one or more cylinders are deactivated via ceasing to supply fuel to engine cylinders. The method further comprises entering the cylinder deactivation mode after counting an actual total number of engine events since a first estimate of roughness of the road exceeded the threshold, the first estimate occurring after a last estimate of roughness of the road that did not exceed the threshold.

The method also includes where the actual total number of engine events is an actual total count of ignitions of air-fuel mixtures in engine cylinders. The method includes where the actual total number of engine events is an actual total count of exhaust valve opening events. The method includes where increasing an actual total number of available cylinder modes includes increasing an actual total number of cylinder modes where less than all cylinders of an engine are active. The method includes where the roughness of the road is based on vertical acceleration of a sprung vehicle mass.

The method of FIGS. 5 and 6 also provides for an engine control method, comprising: increasing an actual total number of available cylinder modes from a first actual total number of available cylinder modes to a second actual total number of available cylinder modes via a controller in response to changing from a first suspension control mode to a second suspension control mode; and operating an engine via the controller in a cylinder deactivation mode after changing from the first suspension control mode to the second suspension control mode. The method further comprises increasing the actual total number of available cylinder modes in further response to an estimate of road roughness. The method includes where the estimate of road roughness indicates road roughness is increasing. The method includes where the first suspension mode includes a higher dampening ratio than the second suspension mode. The method further comprises decreasing an actual total number of available cylinder modes from the second actual total number of available cylinder modes to the first actual total number of available cylinder modes via the controller in response to changing from the second suspension control mode to the first suspension control mode. The method includes where increasing an actual total number of available cylinder modes includes increasing an engine speed range where the actual total number of available cylinder modes may be activated. The method includes where increasing an actual total number of available cylinder modes includes increasing an engine torque range where the actual total number of available cylinder modes may be activated.

The method of FIGS. 5 and 6 also provides for an engine control method, comprising: increasing an actual total number of available cylinder modes from a first actual total number of available cylinder modes to a second actual total number of available cylinder modes via a controller in response to a frequency of vertical acceleration of a mass of a vehicle's suspension and a power of vertical acceleration of the mass of the vehicle's suspension; and operating an engine via the controller in a cylinder deactivation mode after increasing the actual total number of available cylinder modes. The engine control method further comprises increasing the actual total number of available cylinder modes in further response to engine firing frequency being greater than the frequency of vertical acceleration of the mass. The engine control method includes where the power of vertical acceleration of the mass is greater than a threshold. The engine control method further comprises decreasing the actual total number of available cylinder modes from the second actual total number of available cylinder modes to the first actual total number of available cylinder modes in response to the power of vertical acceleration of the mass being less than the threshold. The engine control method includes where increasing an actual total number of available cylinder modes includes increasing an engine speed range where the actual total number of available cylinder modes may be activated. The engine control method includes increasing an actual total number of available cylinder modes includes increasing an engine torque range where the actual total number of available cylinder modes may be activated.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An engine control method, comprising:

increasing an actual total number of available cylinder modes from a first actual total number of available cylinder modes to a second actual total number of available cylinder modes via a controller in response to an estimate of roughness of a road exceeding a threshold; and operating an engine via the controller in a cylinder deactivation mode after increasing the actual total number of available cylinder modes, the cylinder deactivation mode entered after counting an actual total number of engine events since a first estimate of roughness of the road exceeded the threshold, the first estimate occurring after a last estimate of roughness of the road that did not exceed the threshold.

2. The method of claim 1, where the available cylinder modes include cylinder modes where one or more cylinders are deactivated via ceasing to supply fuel to engine cylinders.

3. The method of claim 1, further comprising increasing the actual total number of available cylinder modes from the first actual total number of available cylinder modes to the second actual total number of available cylinder modes via the controller in response to changing from a first suspension control mode to a second suspension control mode.

4. The method of claim 3, where the actual total number of engine events is an actual total count of ignitions of air-fuel mixtures in engine cylinders.

5. The method of claim 3, where the actual total number of engine events is an actual total count of exhaust valve opening events.

6. The method of claim 1, where increasing the actual total number of available cylinder modes includes increasing an actual total number of cylinder modes where less than all cylinders of an engine are active.

7. The method of claim 1, where the roughness of the road is further based on vertical acceleration of a sprung vehicle mass.

8. An engine control method, comprising:

increasing an actual total number of available cylinder modes from a first actual total number of available cylinder modes to a second actual total number of available cylinder modes via a controller in response to changing from a first suspension control mode to a second suspension control mode; and operating an engine via the controller in a cylinder deactivation mode after changing from the first suspension control mode to the second suspension control mode.

9. The method of claim 8, further comprising increasing the actual total number of available cylinder modes in further response to an estimate of road roughness.

10. The method of claim 9, where the estimate of road roughness indicates road roughness is increasing.

11. The method of claim 8, where the first suspension mode includes a higher dampening ratio than the second suspension mode.

12. The method of claim 8, further comprising decreasing the actual total number of available cylinder modes from the second actual total number of available cylinder modes to the first actual total number of available cylinder modes via the controller in response to changing from the second suspension control mode to the first suspension control mode.

13. The method of claim 8, where increasing the actual total number of available cylinder modes includes increasing an engine speed range where the actual total number of available cylinder modes may be activated.

14. The method of claim 8, where increasing the actual total number of available cylinder modes includes increasing an engine torque range where the actual total number of available cylinder modes may be activated.

15. An engine control method, comprising:

increasing an actual total number of available cylinder modes from a first actual total number of available cylinder modes to a second actual total number of available cylinder modes via a controller in response to a frequency of vertical acceleration of a mass of a vehicle's suspension exceeding a threshold and a power of vertical acceleration of the mass of the vehicle's suspension; and operating an engine via the controller in a cylinder deactivation mode after increasing the actual total number of available cylinder modes.

16. The method of claim 15, further comprising increasing the actual total number of available cylinder modes in further response to engine firing frequency being greater than the frequency of vertical acceleration of the mass.

17. The method of claim 15, where the power of vertical acceleration of the mass is greater than a threshold.

18. The method of claim 17, further comprising decreasing the actual total number of available cylinder modes from the second actual total number of available cylinder modes to the first actual total number of available cylinder modes in response to the power of vertical acceleration of the mass being less than the threshold.

19. The method of claim 15, where increasing the actual total number of available cylinder modes includes increasing an engine speed range where the actual total number of available cylinder modes may be activated.

20. The method of claim 15, where increasing the actual total number of available cylinder modes includes increasing an engine torque range where the actual total number of available cylinder modes may be activated.

* * * * *